US007335861B2

(12) United States Patent
Gama et al.

(10) Patent No.: US 7,335,861 B2
(45) Date of Patent: Feb. 26, 2008

(54) COOKING STOVE

(75) Inventors: Atsuhito Gama, Nagoya (JP); Shinichiro Hata, Nagoya (JP); Hiroyuki Yamada, Nagoya (JP); Kazuya Hirota, Nagoya (JP)

(73) Assignee: Rinnai Corporation, Nagoya-shi (JP)

( * ) Notice: Subject to any disclaimer, the term of this patent is extended or adjusted under 35 U.S.C. 154(b) by 386 days.

(21) Appl. No.: 11/091,949

(22) Filed: Mar. 29, 2005

(65) Prior Publication Data

US 2005/0217661 A1 Oct. 6, 2005

(30) Foreign Application Priority Data

Mar. 31, 2004 (JP) ..... 2004-102481
Mar. 31, 2004 (JP) ..... 2004-102482

(51) Int. Cl.
*H05B 1/02* (2006.01)

(52) U.S. Cl. ..... 219/506; 219/494; 219/508; 219/412

(58) Field of Classification Search ..... 219/506, 219/501, 494, 497, 499, 490–491, 507, 412–415, 219/508

See application file for complete search history.

(56) References Cited

U.S. PATENT DOCUMENTS

| | | | | |
|---|---|---|---|---|
| 4,391,265 | A * | 7/1983 | Chen | 126/39 E |
| 4,997,161 | A | 3/1991 | Hutchison et al. | 251/129.08 |
| 5,241,463 | A | 8/1993 | Lee | 364/400 |

FOREIGN PATENT DOCUMENTS

| | | |
|---|---|---|
| JP | 58-186302 | 12/1983 |
| JP | 2001-355858 | 12/2001 |
| JP | 2003-279055 | 10/2003 |
| WO | WO 01/29483 | 4/2001 |

OTHER PUBLICATIONS

European Search Report dated Jul. 7, 2005.

* cited by examiner

*Primary Examiner*—Mark Paschall
(74) *Attorney, Agent, or Firm*—Edwards Angell Palmer & Dodge LLP

(57) ABSTRACT

A cooking stove which prevents the quantity of heat generated by a gas burner from increasing continuously contrary to the user's expectations, while allowing the user to easily operate the appliance. A cooking stove includes an operation portion 6 having touch switches provided on a glass top plate 2 covering a top surface of a cooking stove main body 1 accommodating burners 4*a* and 4*b*, the touch switches allowing a user to give instruction on activation of the burners 4*a* and 4*b*, the touch switches sensing an object that contacts or approaches the top surface of the glass top plate 2, and a controller for determining whether each of the touch switches is on (sensing state) or off (non-sensing state) to control activation of the burners 4*a* and 4*b* in accordance with the result of the determination. When a thermal power up switch for the burner 4*a* in the operation portion 6 is kept on while the burner 4*a* is in operation, controller increases the thermal power of the burner 4*a* by only one level. When a thermal power down switch for the burner 4*a* in the operation portion 6 is kept on while the burner 4*a* is in operation, the controller continuously reduces the thermal power of the burner 4*a* by a plurality of levels.

4 Claims, 6 Drawing Sheets

COOKING STOVE

BACKGROUND OF THE INVENTION

1. Field of the Invention

The present invention relates to a cooking stove comprising heating means, and in particular, to a cooking stove comprising an operation section that indicates an operation of heating means on a top surface of a top plate.

2. Description of the Related Art

A drop-in type cooking stove is conventionally known in which a cooking stove main body 101 is buried in an opening formed in a counter top of a system kitchen as shown in FIG. 6. Operation knobs 103*a* and 103*b* are provided on a glass top plate 102 to ignite and extinguish gas burners 100*a* and 100*b* and to adjust thermal power; the glass top plate 102 covers a top surface of the cooking stove main body 101 in which gas burners 100*a* and 100*b* are accommodated (see, for example, Japanese Utility Model Laid-Open No. 58-186302 (1983)).

Such a cooking stove eliminates the need to form an opening through which an operation section is viewed, in a front surface of the counter top as in the case in which a cooking stove comprising an operation section in a front surface is installed. The cooking stove can be easily installed in the counter top. Further, the gas burners can be ignited and extinguished and thermal power adjusted using the operation knobs 103*a* and 103*b*, provided on the top plate 102 and which are thus easy to see. Consequently, a user can operate the cooking stove more easily and effectively.

In the cooking stove shown in FIG. 6, however, the operation knobs 103*a* and 103*b* are arranged so as to project from the top surface of the glass top plate 102. Accordingly, the operation knobs 103*a* and 103*b* may obstruct cooking. Thus, for example, a detecting section of an electrical-capacitance sensor may be provided on a back surface of the glass top plate 102 as means for operating the gas burners 100*a* and 100*b*. On the other hand, a touch switch comprising an operation section may be constructed on a front surface of the glass top plate 102. Further, the top surface of the glass top plate 102 may be made flat.

A thermal power up switch and a thermal power down switch are provided in order to increase and reduce the thermal power of the gas burners 100*a* and 100*b* by a plurality of levels; the thermal power up switch is used to give instruction to the appliance to increase the thermal power and the thermal power down switch is used to give instruction to the appliance to reduce the thermal power. The thermal power up switch is configured so that when the user keeps touching the thermal power up switch to keep it on, the thermal power of the gas burner increases continuously by a plurality of levels.

Similarly, the thermal power down switch is configured so that when the user keeps touching the thermal power down switch to keep it on, the thermal power of the gas burner decreases continuously by a plurality of levels.

However, if the thermal power up switch is such a touch switch, it may be kept on when covered with a cooked material boiling over from a pan placed on trivets 104*a* and 104*b* or an object falling onto the top plate 102 during cooking.

Further, for example, while the right burner 100*b* is being used for cooking, when the thermal power up switch is turned on owing to a factor different from the user's operation as described above, the thermal power of the right gas burner 100*b* is increased. In this case, when the up switch for the right burner 100*b* is kept on, the thermal power of the right burner 100*b* increases continuously contrary to the user's expectations. Then, disadvantageously, the cooked material may be excessively heated and the cooking may fail.

Thus, it is an object of the present invention to provide a cooking stove which eliminates the above disadvantages and which prevents the quantity of heat generated by heating means from increasing continuously contrary to the user's expectations, while allowing the user to easily operate the appliance.

SUMMARY OF THE INVENTION

To accomplish the above object, the present invention relates to a cooking stove comprising touch switches provided on a top plate covering a top surface of a cooking stove main body accommodating heating means, the touch switches allowing a user to give an instruction on activation of the heating means, the touch switches sensing an object that contacts or approaches the top surface of the top plate, heat quantity varying means for varying the heat quantity of the heating means, among a plurality of preset levels, and heating control means for making the heat quantity varying means to increase the heat quantity of the heating means by one level when a heat quantity up switch included in the touch switches for giving an instruction on an increase of the heat quantity of the heating means, shifts from a non-sensing state to a sensing state while the heating means is in operation, and making the heat quantity varying means to reduce the heat quantity of the heating means by one level when a heat quantity down switch included in the touch switches for giving an instruction on a decrease of the heat quantity of the heating means shifts from the non-sensing state to the sensing state while the heating means is in operation.

The present invention is characterized in that while the heating means is in operation, when the heat quantity up switch shifts from the non-sensing state to the sensing state and the sensing state is then maintained, the heat control means prohibits the heat quantity varying means from increasing the heat quantity of the heating means and when the heat quantity down switch shifts from the non-sensing state to the sensing state and the sensing state is then maintained, the heat control means makes the heat quantity varying means to continuously reduce the heat quantity of the heating means by a plurality of levels.

According to the present invention, when the heat quantity up switch is maintained in the sensing state, the heating control means increases the heat quantity of the heating means by one level and maintains the resulting level. This prevents the heat quantity of the heating means from increasing by a plurality of levels when the heat quantity up switch is maintained in the sensing state owing to a factor different from the user's operation such as a boiling-over cooked material. It is thus possible to prevent the heat quantity of the heating means from increasing excessively contrary to the user's expectations.

On the other hand, when the heat quantity down switch is maintained in the sensing state, the heating control means continuously reduces the heat quantity of the heating means by a plurality of levels. Thus, if for example, a cooked material boils over, the user can quickly reduce the heat quantity of the heating means by keeping operating the heat quantity down switch to maintain it in the sensing state. This allows the user to easily operate the cooking stove.

Further, the present invention is characterized in that while the heating means is in operation, when the heat quantity up switch shifts from the non-sensing state to the sensing state and the sensing state is then maintained, the heat control means prohibits the heat quantity varying means from increasing the heat quantity of the heating means and makes the heat quantity varying means to reduce the heat quantity of the heating means by one level.

According to the present invention, when the heat quantity up switch shifts from the non-sensing state to the sensing state, the heating control means increases the heat quantity of the heating means by one level. However, subsequently, when the heat quantity up switch is maintained in the sensing state, the heating control means reduces the heat quantity of the heating means by one level.

Thus, even if the heat quantity up switch shifts from the non-sensing state to the sensing state owing to boiling-over cooked material or the like and is then maintained in the sensing state, the heat quantity of the heating means returns to a value set when the heat quantity up switch is in the non-sensing state. This makes it possible to avoid maintaining the heat quantity of the heating means at an increased value. It is thus possible to prevent the cooked material from being excessively heated contrary to the user's expectations.

Furthermore, the present invention is characterized by further comprising heat quantity display means for indicating to which of the plurality of levels the heat quantity of the heating means corresponds while the heating means is in operation.

According to the present invention, even when the user keeps operating the heat quantity up switch, the heat quantity of the heating means increases by only one level. However, when the user keeps operating the heat quantity down switch, the heat quantity of the heating means decreases by a plurality of levels. Then, when a continuous variation in heat quantity is enabled if an operation of increasing the heat quantity is performed and is disabled if an operation of reducing the heat quantity is performed, the user may have an incongruous feeling about the operation. Thus, the heat quantity display means displays the heat quantity of the hearting means so that the user can visually recognize that the heat quantity of the heating means increases by only one level even with a continuous operation of the heat quantity up switch. This inhibits the user from having an incongruous feeling as described above.

Moreover, according to the present invention, when the user keeps operating the heat quantity up switch to maintain the heat quantity up switch in the sensing state, the heat quantity of the heating means is increased but the heating control means reduces the increased heat quantity by one level to return it to a value set before the operation. In this case, although the user operates the heat quantity up switch in expectation of an increase in the heat quantity of heating means, the heat quantity of the heating means increases but then returns to the preceding value. Consequently, the user may have an incongruous feeling.

Thus, the heat quantity display means displays the heat quantity of the heating means so that the user can visually recognize that a continuous operation of the heat quantity up switch returns the heat quantity of the heating means to the previous value and then keeps it unchanged. This inhibits the user from having an incongruous feeling as described above.

DETAILED DESCRIPTION OF THE PREFERRED EMBODIMENT

Figure 2:
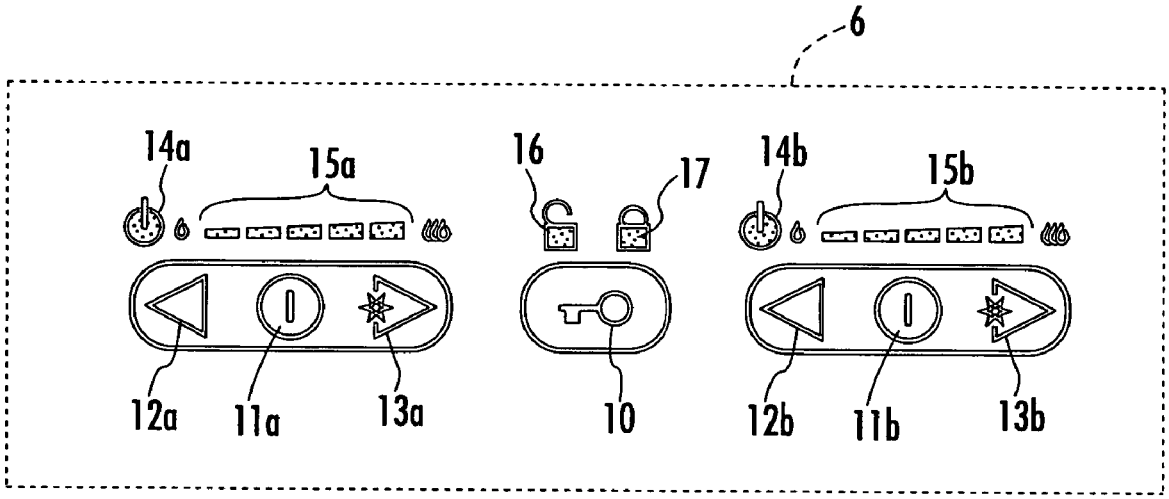
FIG. 2 is a detailed diagram of an operation section shown in FIG. 1.
Figure 3:
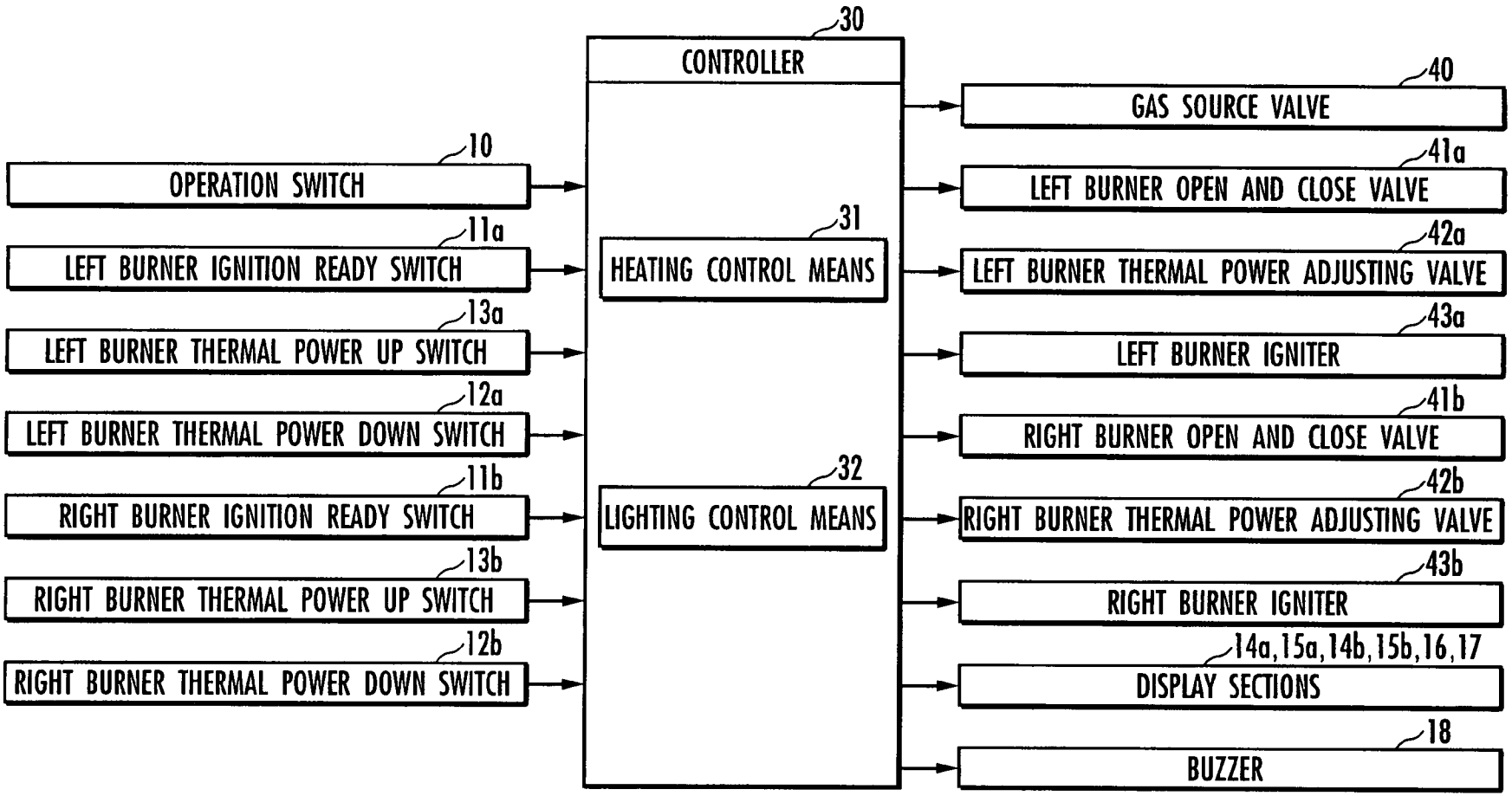
FIG. 3 is a control block diagram of the cooking stove.
Figure 4:
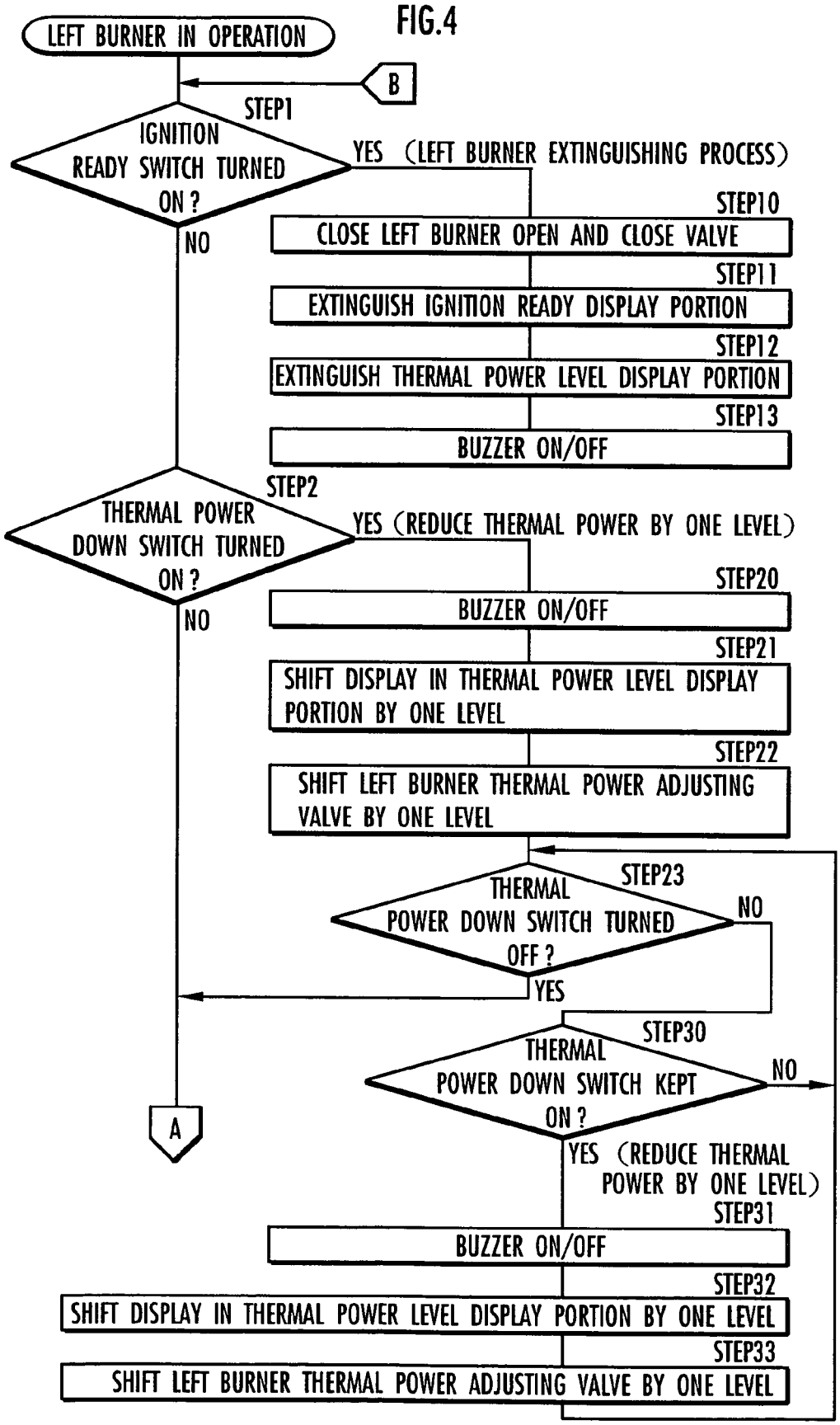
FIG. 4 is a flowchart of a process of changing firepower of a burner.
Figure 5:
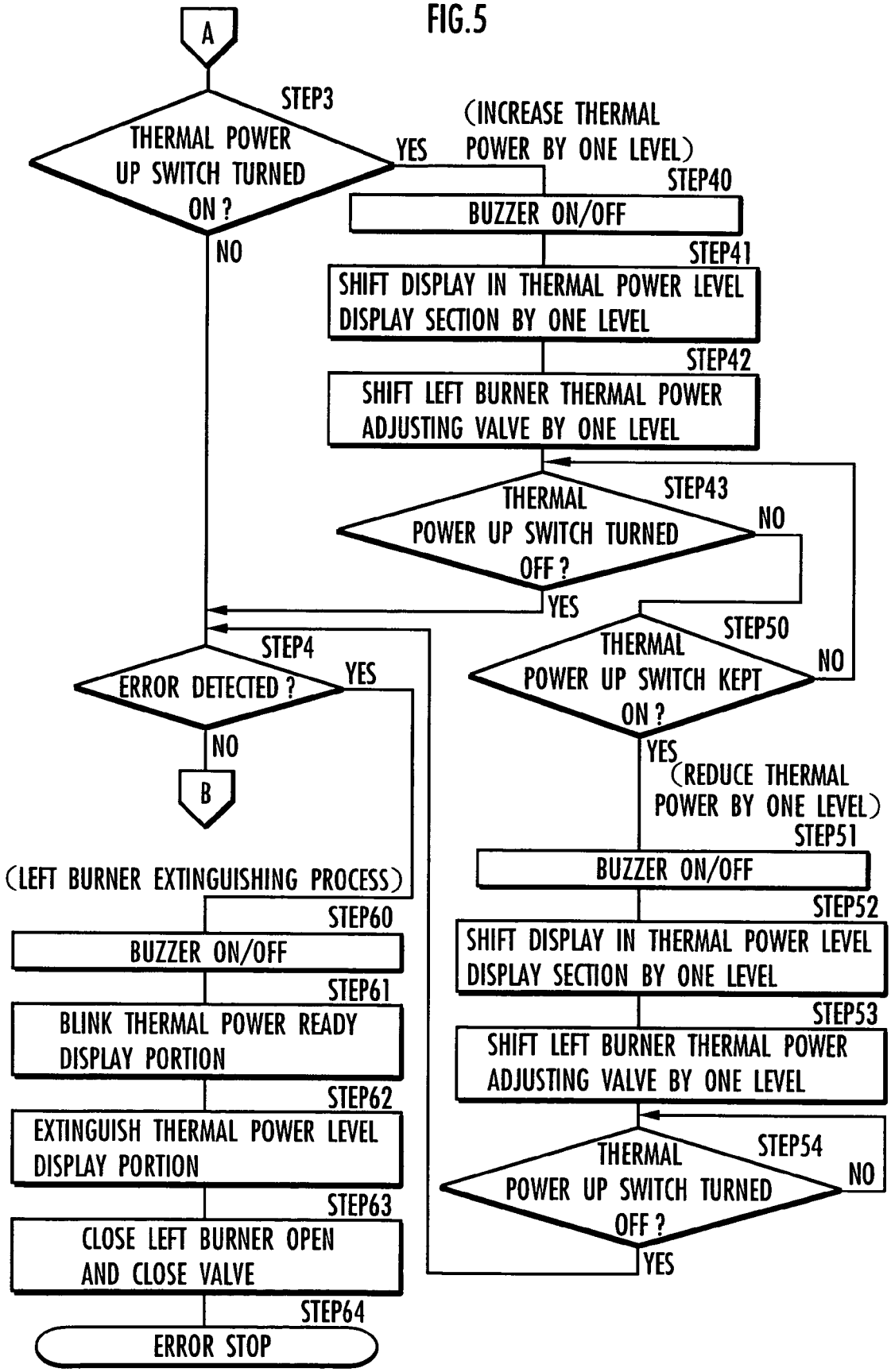
FIG. 5 is a flowchart of a process of changing firepower of a burner.
Figure 6:
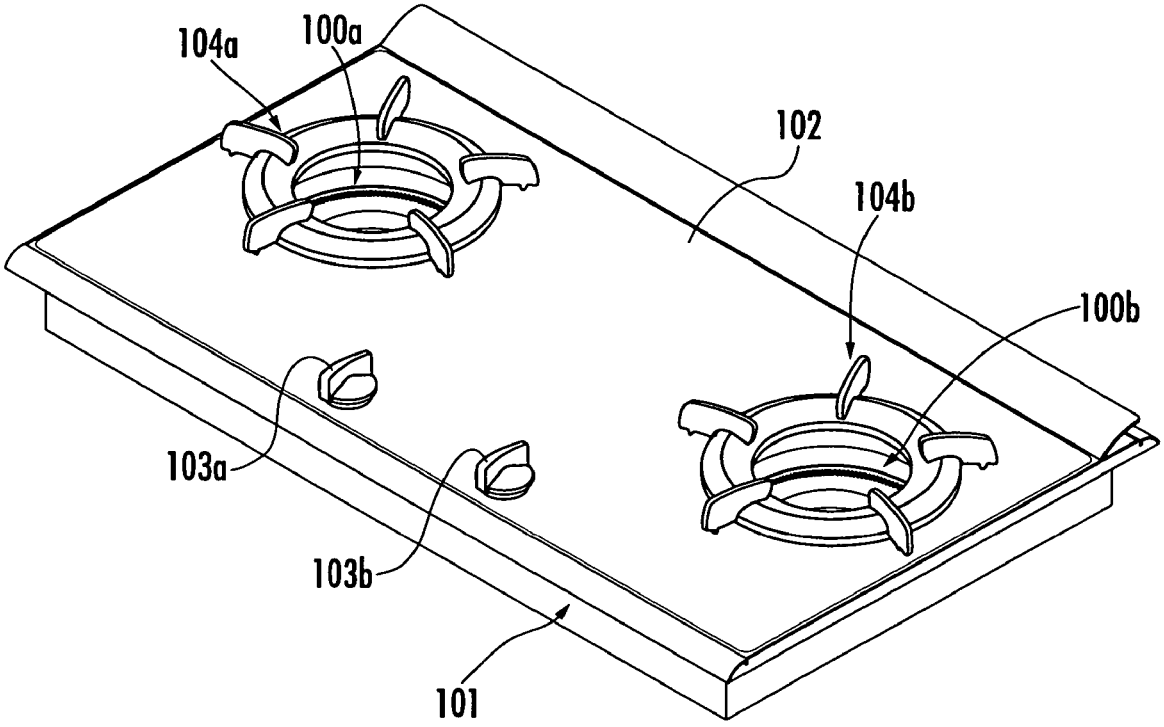
FIG. 6 is a diagram of the appearance of a conventional cooking stove.

An embodiment of the present invention will be described with reference to FIGS. 1 to 5. FIG. 1 is a diagram showing the appearance of a cooking stove according to the present invention. FIG. 2 is a detailed diagram of an operation section shown in FIG. 1. FIG. 3 is a control block diagram of the cooking stove. FIGS. 4 and 5 are flowcharts of a process of changing firepower of a burner.

Figure 1A:
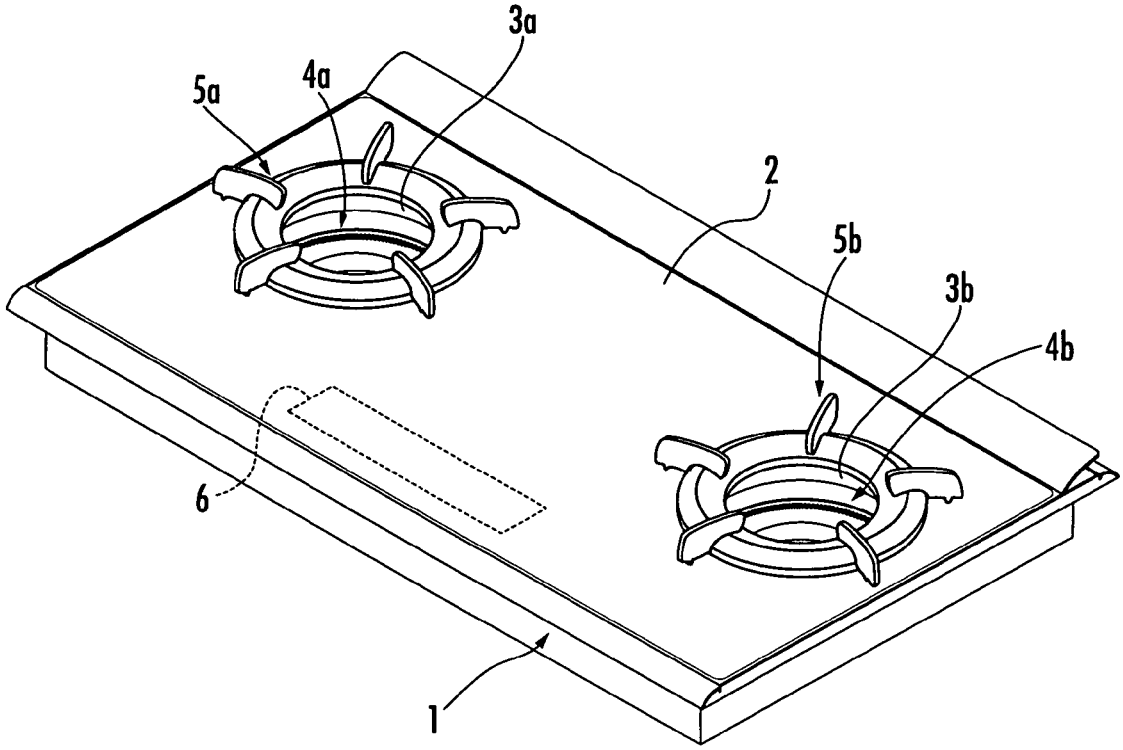
FIG. 1 is a diagram showing the appearance of a cooking stove according to the present invention.

FIG. 1 shows a drop-in type cooking stove in which a glass top plate 2 formed of crystallized glass, which has excellent heat resistance, is installed on a top surface of a cooking stove main body 1. With reference to FIG. 1A, a lateral pair of cooking stove openings 3*a* and 3*b* is formed in the glass top plate 2. A left burner 4*a* and a right burner 4*b* (corresponding to heating means according to the present invention) are provided in the cooking stove main body 1 so as to be viewed through the cooking stove openings 3*a* and 3*b*. Further, the trivets 5*a* and 5*b* are arranged in the cooking stove openings 3*a* and 3*b*; cooking containers are placed on the trivets 5*a* and 5*b*. An operation section 6 is provided on the front side of a top surface of the glass top plate 2 to give an instruction for activating the left burner 4*a* and the right burner 4*b*.

With reference to FIG. 2, the operation section 6 comprises an operation switch 10 that switches between an "operation state" in which the left burner 4*a* and the right burner 4*b* can be instructed on actuation while the cooking stove remains powered on and a "standby state" in which the burners cannot be instructed on actuation. Further, to give instruction on actuation of the left burner 4*a*, the operation section 6 is provided with an ignition ready switch 11*a* that allows the left burner 4*a* to get ready for ignition, a thermal power down switch 12*a* (corresponding to a heating quantity down switch of the invention) and a thermal power up switch 13*a* (corresponding to a heating quantity up switch of the invention) which switch the thermal power of the left burner 4*a* among five levels (levels 1 to 5), an ignition ready display section 14*a* that is lighted while the left burner 4*a* is ready for ignition or is in operation, and thermal power level display section 15*a* (corresponding to heating quantity means according to the present invention) that displays a setting for the thermal power of the left burner 4*a*.

While the left burner 4*a* is ready for ignition, when the thermal power up switch 13*a* is operated, the left burner 4*a* is ignited. On the other hand, while the left burner 4*a* is in operation, when the ignition ready switch 11*a* or the operation switch 10 is operated, the left burner 4*a* is turned off.

Similarly, to give instruction on actuation of the left burner 4*b*, the operation section 6 is provided with an ignition ready switch 11*b* that allows the right burner 4*b* to get ready for ignition, a thermal power down switch 12*b* (corresponding to a heating quantity down switch of the invention) and a thermal power up switch 13*b* (corresponding to a heating quantity up switch of the invention) which switch the thermal power of the right burner 4*b* among five levels (levels 1 to 5), an ignition ready display section 14*b* that is lighted while the right burner 4*b* is ready for ignition or is in operation, and thermal power level display section 15*b* (corresponding to heating quantity means according to the present invention) that displays a setting for the thermal power of the right burner 4*b*.

While the right burner 4*b* is ready for ignition, when the thermal power up switch 13*b* is operated, the right burner 4*b* is ignited. On the other hand, while the right burner 4*b* is in operation, when the ignition ready switch 11*b* or the operation switch 10 is operated, the right burner 4*b* is turned off.

Moreover, the operation section 6 comprises an unlock display section 16 that is lighted in the "operation state" and a lock display section 17 that is lighted when the operations of all the switches are disabled, that is, the appliance is brought into a child lock state, after the operation switch 10 has been continuously operated for more than a predetermined time (for example 4 seconds).

Each of the switches of the operation section 6 is a non-contact type touch switch composed of an electrical-capacitance sensor provided on a back surface of the glass top plate 2 and a print portion printed on a part of the front surface of the glass top plate 2 which is opposite the electrical-capacitance sensor, the print portion showing a touch point of the switch. When an electrostatic object is placed on the print portion (part of the front surface of the glass top plate 2 which is opposite the electrical-capacitance sensor), the electrical-capacitance sensor detects the electrostatic object to turn on the touch switch (this corresponds to a sensing state according to the present invention). When the electrostatic object is not placed on the print portion, the electrical-capacitance sensor does not detect the electrostatic object, the touch switch remains off (this corresponds to a non-sensing state according to the present invention).

Further, each of the display sections of the operation section 6 is composed of a LED provided on the back surface of the glass top plate 2 and a print portion printed on a part of the front surface of the glass top plate 2 which is opposite the LED. When the LED is turned on, the display section is lighted. When the LED is turned off, the display section is extinguished.

The thermal power level display section 15*a* indicates the thermal power level (levels 1 to 5) of the left burner 4*a* using the number of lighting portions lighted, the lighting portions being provided in a bar display consisting of five lighting portions; the lighting starts with the leftmost lighting portion and the number of lighting portions lighted increments as the thermal power increases. For example, when the thermal power level of the left burner 4*a* is 1, the only the leftmost lighting portion of the bar display is lighted. When the thermal power level of the left burner 4*a* is 5, the five lighting portions of the bar display are all lighted. Similarly, the thermal power level display section 15*b* indicates the thermal power level (levels 1 to 5) of the right burner 4*b* using the number of lighting portions lighted, the lighting portion being provided in a bar display consisting of five lighting portions; the lighting starts with the leftmost lighting portion and the number of lighting portions lighted increments as the thermal power increases.

Now, with reference to FIG. 3, the cooking stove 1 internally comprises a controller 30 that controls the general actuation of the cooking stove. A sensing signal for the operational state of each of the switches (operation switch 10, ignition ready switches 11*a* and 11*b*, thermal power down switches 12*a* and 12*b*, and thermal power up switches 13*a* and 13*b*) of the operation section 6 is input to the controller 30.

Control signals output by the controller 30 controls the actuation of a gas source valve 40 that switches between the supply of fuel gas to the cooking stove main body 1 and the blockage of the supply, a left burner open and close valve 41*a* that switches between the supply of fuel gas to the left burner 4*a* and the blockage of the supply, a left burner thermal power adjusting valve 42*a* (corresponding to a heating quantity changing means of the invention) that varies the flow rate of fuel gas supplied to the left burner 4*a*, a left burner igniter 43*a* that applies a high voltage to an ignition electrode (not shown) of the left burner 4*a* to cause spark discharge, a right burner open and close valve 41*b* that switches between the supply of fuel gas to the right burner 4*b* and the blockage of the supply, a right burner thermal power adjusting valve 42*b* (corresponding to a heating quantity changing means of the invention) that varies the flow rate of fuel gas supplied to the right burner 4*b*, and a right burner igniter 43*b* that applies a high voltage to an ignition electrode (not shown) of the right burner 4*b* to cause spark discharge.

Moreover, control signals from the controller 30 control lighting/extinction of the display sections provided in the operation section 6 (ignition ready display sections 14*a* and 14*b*, thermal power level display sections 15*a* and 15*b*, unlock display section 16, and lock display section 17) and turn-on and off of a buzzer 18.

The controller 30 also comprises heating control means 31 for controlling the actuation of the left burner 4*a* and right burner 4*b*, and lighting control means 32 for controlling the lighting/extinction of the display sections provided in the operation section 6 and reporting by the buzzer 18.

While the left burner 4*a* is in operation, when the user touches the thermal power up switch 13*a* for the left burner to turn on the thermal power up switch 13*a*, the heating control means 31 increases the thermal power of the left burner 4*a*. Similarly, while the right burner 4*b* is in operation, when the user touches the thermal power up switch 13*b* for the right burner to turn on the thermal power up switch 13*b*, the heating control means 31 increases the thermal power of the right burner 4*b*.

Figure 1B:
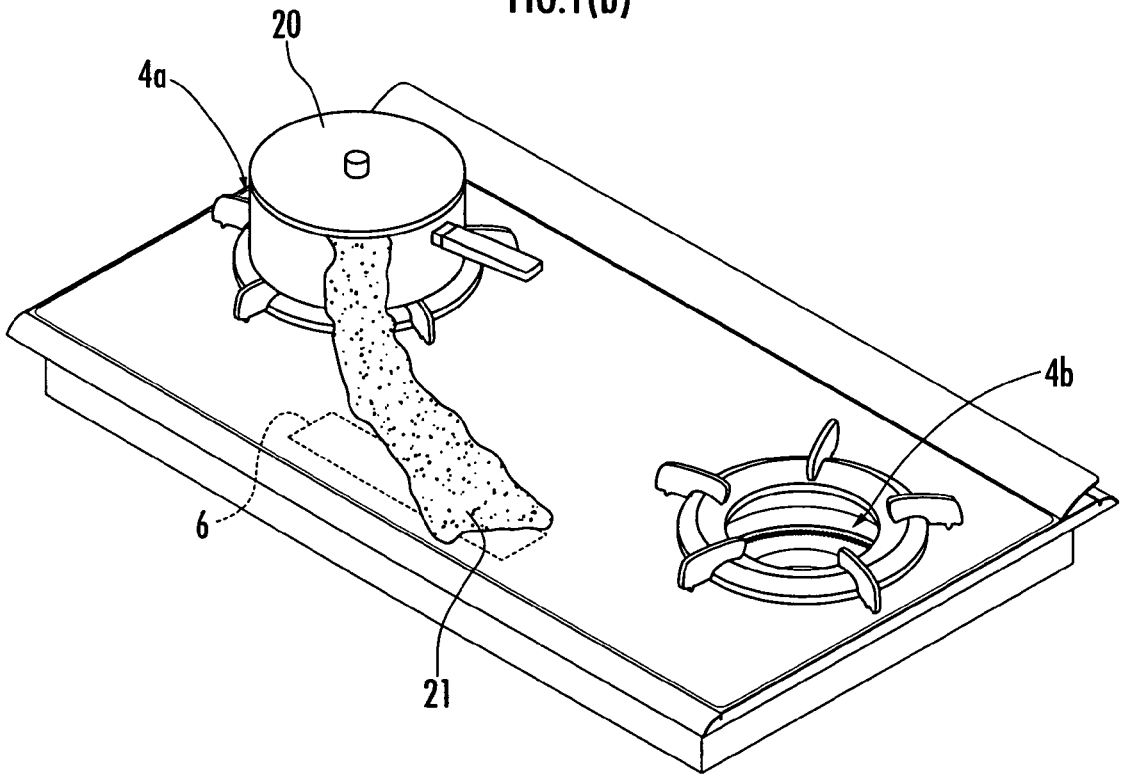

However, as described above, the touch switches provided in the operation portion 6 sense whether or not an electrostatic object is present on the top surface of the glass top plate 2. Thus, any of the touch switches may be turned on even though the user does not touch it. For example, as shown in FIG. 1B, while the left burner 4*a* is being used to heat a cooked material in a pan 20, the cooked material may boil over from the pan 20. The boiling-over cooked material 21 may then reach the operation portion 6 to turn on any of the touch switches.

Any of the touch switches may be turned on if the operation portion 6 is covered with an object (cloth, food, or the like) having fallen onto the glass top plate 2 or if an insect or the like moves onto the operation portion 6.

Then, while the left burner 4*a* is in operation, if the thermal power up switch 13 for the left burner 4*a* is kept on due to a factor other than the user's operation, a continuous increase in the thermal power of the left burner 4*a* causes the cooked material to be excessively heated contrary to the user's expectations. As a result, the cooking may fail. This also applies to the case where the thermal power switch 13*b* for the right burner 4*b* is kept on while the right burner 4*b* is in operation.

Thus, when the thermal power up switch 13*a* for the left burner 4*a* is kept on while the left burner 4*a* is in operation, the heating control means 31, provided in the controller 30, executes such a process as prevents the burning quantity of the left burner 4*a* from increasing continuously. Similarly, when the thermal power up switch 13*b* for the right burner 4*b* is kept on while the right burner 4*b* is in operation, the heating control means 31 executes such a process as prevents the burning quantity of the right burner 4*b* from increasing continuously.

This process will be described with reference to the flowchart in FIGS. 4 and 5. The flowchart in FIGS. 4 and 5 relates to a process for the left burner 4*a*. This also applies to a process for the right burner 4*b*.

The heating control means 31 repeats a loop from STEP1 in FIG. 4 to STEP4 in FIG. 5 while the left burner 4*a* is in operation. Then, in STEP1, when the ignition ready switch 11*a* is turned on, the process branches to STEP10. The heating control means 31 opens the left burner open and close valve 41*a* to extinguish the left burner 4*a*.

STEP11 and STEP12 are executed by the lighting control means 32. In STEP11, the lighting control means 32 extinguishes the ignition ready display section 14*a*. In STEP12, the lighting control means 32 extinguishes the thermal power level display section 15*a*. In STEP13, the lighting control means 32 activates the buzzer 18 to notice the user that the left burner 4*a* has been extinguished.

Then, in STEP2, when the thermal power down switch 12*a* is turned on, the process branches to STEP20. The processing in STEP20 to STEP22 reduces the thermal power of the left burner 4*a* by one level. In STEP20, the lighting control means 32 activates the buzzer 18. In STEP21, the lighting control means 32 then reduces a thermal power level shown in the bar display in the thermal power level display portion 15*a* by one level in a negative direction (in FIG. 2, leftward) to notice the user of the reduction in thermal power or the left burner 4*a*. Subsequently, in STEP 22, the heating control means 31 reduces the opening degree of the left burner thermal power adjusting valve 42*a* by one level. This in turn reduces the thermal power of the left burner 4*a* by one level.

Then, in STEP23, if the thermal power down switch 12*a* is turned off, the process advances to STEP3 in FIG. 5. If the thermal power down switch 12*a* remains on, the process proceeds to STEP30. In STEP30, when the thermal power down switch 12*a* is in a "continuous on state" in which it is kept on for a predetermined time (for example, 1 second), the process advances to STEP31. The processing in STEP31 to STEP33 is similar to that in STEP20 to STEP22, described above, and reduces the thermal power of the left burner 4*a* by one level.

The process returns from STEP33 to STEP23. When the thermal power down switch 12*a* is in the "continuous on state", the process advances from STEP30 to STEP31 to repeat the processing in STEP31 to STEP33. Thus, the user can quickly reduce the thermal power of the left burner 4*a* to the minimum level (level 1) by keeping touching the thermal power down switch 12*a*.

Then, in STEP3 in FIG. 5, when the thermal power up switch 13*b* is turned on, the process branches to STEP40. In STEP40, the lighting control means 32 activates the buzzer 18. In STEP42, the lighting control means 32 then reduces a thermal power level shown in the bar display in the thermal power level display portion 15*a* by one level in a positive direction (in FIG. 2, rightward). The lighting control means 32 then notices the user of the increase in thermal power of the left burner 4*a*. Subsequently, in STEP41, the heating control means 31 increases the opening degree of the left burner thermal power adjusting valve 42*a* by one level. This in turn increases the thermal power of the left burner 4*a* by one level.

Then, in STEP43, if the thermal power up switch 13*a* is turned off, the process advances to STEP4. If the thermal power up switch 13*a* remains on, the process proceeds to STEP50. In STEP50, when the thermal power up switch 13*a* is in the "continuous on state", the process advances to STEP51.

The processing in STEP51 to STEP53 is similar to that in STEP20 to STEP22, described above, and reduces the thermal power of the left burner 4*a* by one level. In STEP54, the process waits for the thermal power up switch 13*a* to be turned off. When the thermal power up switch 13*a* is turned off, the process advances to STEP4. Thus, when the thermal power up switch 13*a* is brought into the "continuous on state", the thermal power of the left burner 4*a*, increased by one level in STEP42, is reduced by one level to the previous value in STEP53.

In this case, it is assumed that when the operation portion 6 is covered with a boiling-over cooked material or the like to turn on the thermal power up switch 13*a* owing to the factor different from the user's operation, the thermal power up switch 13*a* is kept on for a certain time. Thus, this corresponds to the "continuous on state" and the process advances from STEP50 to STEP51. In STEP53, the thermal power of the left burner 4*a* decreases by one level.

Thus, the thermal power of the left burner 4*a* is maintained in a state present before the thermal power up switch 13*a* is turned on owing to a boiling-over cooked material or the like. Thus, when the operation portion 6 is covered with a boiling-over cooked material or the like to turn on the thermal power up switch 13*a*, the thermal power of the left burner 4*a* is maintained at an increased level. This makes it possible to prevent the cooked material from being excessively heated.

On the other hand, when desiring to increase the thermal power of the left burner 4*a*, the user may touch the thermal power up switch 13*a* for the left burner with his or her finger and takes the finger off the switch 13*a* before the switch 13*a* is brought into the "continuous on state". Thus, the process advances from STEP43 to STEP4 in FIG. 5. In STEP42, the thermal power of the left burner 4*a* is maintained at the level increased by one.

Then, in STEP4, when an error such as an accidental fire in the left burner 4*a* is detected, the process branches to STEP60. In STEP60, the lighting control means 32 activates the buzzer 18. In STEP 61, the lighting control means 32 blinks the ignition ready display section 14*a* to notice the user of the error. Then, in STEP62, the lighting control means 32 extinguishes the thermal power level display section 15*a*. Subsequently, in STEP63, the heating control means 31 closes the open and close valve 41*a* for the left burner to block the supply of fuel gas to the left burner 4*a*. The process advances to STEP64 to bring the cooking stove into an error stop state.

In the present embodiment, when the thermal power up switch 13*a* is brought into the "continuous on state" in STEP50 in FIG. 5, the thermal power of the left burner 4*a* is reduced by one level in STEP53. However, the thermal power of the left burner 4*a* may be maintained at the current level without executing the processing in STEP51 to STEP53.

In the present embodiment, the cooking stove comprising the gas burners 4*a* and 4*b* is shown as the heating means according to the present invention. However, the present invention is applicable to a cooking stove comprising another type of heating means such as an electric heater.

In the present embodiment, the cooking stove comprises the glass top plate 2, composed of heat-resistant glass, as the top plate according to the present invention. However, the present invention is applicable to a cooking stove comprising a top plate of another material such as stainless steel.

Further, in the present embodiment, the cooking stove includes the electrical-capacitance touch switches as the touch switches according to the present invention. However, the type of the touch switches is not limited to this. The present invention is applicable to a cooking stove including photo switches comprising infrared emitting/receiving sections or mechanical contact type touch switches such as tact switches.

What is claimed is:

1. A cooking stove comprising:

touch switches provided on a top plate covering a top surface of a cooking stove main body accommodating heating means, the touch switches allowing a user to give an instruction on activation of the heating means, the touch switches sensing an object that contacts or approaches the top surface of the top plate, wherein one of the touch switches is a heat quantity up switch for providing an instruction on an increase of the heat quantity of the heating means and one of the touch switches is a heat quantity down switch for providing an instruction on a decrease of the heat quantity of the heating means;

heat quantity varying means for varying the heat quantity of the heating means, among a plurality of preset levels; and heating control means which increases the heat quantity of the heating means by one level by using the heat quantity varying means when the heat quantity up switch shifts from a non-sensing state to a sensing state while the heating means is in operation, and reduces the heat quantity of the heating means by one level by using the heat quantity varying means when the heat quantity down switch shifts from the non-sensing state to the sensing state while the heating means is in operation, and wherein while the heating means is in operation, when the heat quantity up switch shifts from the non-sensing state to the sensing state and the sensing state is then maintained, the heat control means prohibits the heat quantity varying means from increasing the heat quantity of the heating means and when the heat quantity down switch shifts from the non-sensing state to the sensing state and the sensing state is then maintained, the heat control means continuously reduces the heat quantity of the heating means by a plurality of levels by using the heat quantity varying means.

2. The cooking stove according to claim 1, wherein while the heating means is in operation, when the heat quantity up switch shifts from the non-sensing state to the sensing state and the sensing state is then maintained, the heat control means prohibits the heat quantity varying means from increasing the heat quantity of the heating means and makes the heat quantity varying means to reduce the heat quantity of the heating means by one level.

3. The cooking stove according to claim 1, further comprising heat quantity display means for indicating to which of the plurality of levels the heat quantity of the heating means corresponds while the heating means is in operation.

4. The cooking stove according to claim 2, further comprising heat quantity display means for indicating to which of the plurality of levels the heat quantity of the heating means corresponds while the heating means is in operation.

* * * * *